United States Patent [19]

Loizeaux

[11] Patent Number: 4,993,004

[45] Date of Patent: Feb. 12, 1991

[54] PASSIVELY ACTIVATED LAP COUNTER AND TIMER

[76] Inventor: Marion A. Loizeaux, 45 Zaccheus Mead, Greenwich, Conn. 06831

[21] Appl. No.: 295,783

[22] Filed: Jan. 11, 1989

[51] Int. Cl.[5] ..... G04C 17/00

[52] U.S. Cl. ..... 368/107; 368/111; 368/69; 368/281

[58] Field of Search ..... 368/10, 101–113, 368/69; 377/24.2

[56] References Cited

U.S. PATENT DOCUMENTS

| | | | |
|---|---|---|---|
| 4,396,296 | 8/1983 | Stodden | 368/101 |
| 4,468,134 | 8/1990 | Halicho | 368/69 |
| 4,518,266 | 5/1985 | Dawley | 368/10 |
| 4,681,462 | 7/1987 | Lloyd | 368/69 |
| 4,700,369 | 10/1987 | Siegal et al. | 377/242 |
| 4,823,367 | 4/1989 | Kreutzfeld | 377/24.2 |
| 4,831,605 | 5/1989 | Suga | 368/113 |

*Primary Examiner*—Bernard Roskoski
*Attorney, Agent, or Firm*—Fred A. Keire

[57] ABSTRACT

A wearable device for automatically counting and timing the repetitions or laps during an athletic activity. The device preferably is worn either on the palm of the hand or the ball of the foot and comprises a raised, pressure-sensitive area which is depressed automatically through contact with a solid surface as part of the user's natural action in completing a lap or repetition. The device preferably also comprises a watertight case enclosing a microprocessor circuit which records and calculates various information for the user and displays this information on a liquid crystal display. Selecting means are provided on the case for selecting the information appearing on the display such as laps completed, total distance traveled, time to complete each lap, average lap time, average speed, total elapsed time, real time, and best lap time. An adjustable strap holds the device to the user's body.

27 Claims, 2 Drawing Sheets

PASSIVELY ACTIVATED LAP COUNTER AND TIMER

BACKGROUND OF THE INVENTION

This invention relates to devices for counting and timing and, more particularly, to devices for counting and timing repetitions or laps in an athletic activity.

Devices for counting and timing repetitions or laps in an athletic activity fall into three broad categories:

(1) devices that are permanently fixed to, e.g., starting blocks or a pool wall such as the device disclosed in U.S. Pat. No. 3,916,214;

(2) devices which are portable and placed for use by a participant in the activity at an appropriate location such as that disclosed in U.S. Pat. No. 4,700,369; and (3) devices which are worn by the participant and are activated by him or her, or which activate automatically, such as that disclosed in U.S. Pat. No. 4,530,105.

There are problems and limitations with all of these devices. Fixed devices are costly and must be maintained by individuals other than the athletic participant. Also, such devices generally cannot be used by more than one person at a time, a problem which, for recreational swimmers, is significant because they usually share lanes with other swimmers.

Although portable devices are individually maintained and located by the participant, they must be touched to register the completion of a lap or repetition. Thus, the participant's natural athletic motion must be altered to bring a portion of his or her body into contact with a target area on the device. This altered motion is particularly significant for swimmers executing a "flip turn" because their feet must contact the target area while simultaneously executing the turn under water. Also, the target area may be blocked by other swimmers or runners, or other swimmers or runners may accidentally contact the target area. These devices also require time to set up and may be stolen easily.

Devices worn by the participant also can interrupt natural athletic motion because after each lap or repetition, the participant must activate the device, generally by pushing a button or taking some other affirmative action. Generally, such devices are worn on the wrist, and the opposite hand is used to depress the button. This action is disruptive, and the participant often forgets to push the button after completing a repetition. Although devices which activate automatically through detecting a change in direction have been disclosed, they are inaccurate and can be activated inadvertently by turning the body. Also, when used for swimming, the completion of a lap is not recorded when the participant touches the pool wall but rather only after a change in direction. For an event in which there is no change in direction, the lap's completion is not recorded at all. Also, a swimmer cannot wear such a device on his or her wrist because the natural motion of a stroke registers the completion of a lap. Although such a device could be fixed to the swimmer's goggles with the display portion mounted in the lens, viewing of the display is difficult, especially for swimmers whose vision requires correction.

Accordingly, it is an object of the present invention to provide a device for counting and timing repetitions or laps in an athletic activity which overcomes or greatly alleviates the foregoing problems and shortcomings of prior devices.

It is a further object of the invention to provide an inexpensive, accurate device for counting and timing repetitions or laps which is portable and can be worn by an athletic participant.

It is a further object of the invention to provide a device for counting and timing repetitions or laps which can be activated by the participant without interrupting his or her natural athletic activity.

It is a further object of the invention to provide a device for counting and timing repetitions or laps which can be worn comfortably on the hand or foot, provides little resistance to air or water and which can be triggered on any fixed object during the natural motion of an athletic activity, such as swimming or running, without the necessity of touching or contacting a specific target area.

A further object of the invention is to provide a device for counting or timing repetitions or laps which can be used easily and effectively during an athletic activity with other participants and which does not require the involvement of other individuals to set up or maintain.

It is still a further object of the invention to provide a device for counting or timing repetitions or laps which is highly accurate, versatile and does not require the participant to change direction, or to locate and touch a specific part or area on the device, to register the completion of a lap or repetition, or to initiate or terminate timing.

It is still a further object of the invention to provide a device for counting or timing repetitions or laps which can calculate and clearly display to the participant the number of repetitions or laps completed, total distance traveled, time to complete each repetition or lap, average repetition or lap time, average speed, total elapsed time, real time, and best repetition or lap time.

It is an object of the invention to provide a device for counting and timing repetitions or laps which is easily worn and read by the participant.

SUMMARY OF THE INVENTION

In accordance with the present invention, the foregoing objects are met by providing a portable device for counting and timing repetitions or laps which the participant can affix to his or her body and which is activated when a surface of the device makes contact with any other fixed surface. Preferably, the device is worn by the user in the padded portion of the palm of his or her hand (behind the knuckles), or on the ball of his or her foot, and the timing or counting of a lap or repetition is effected when his or her hand or foot makes contact with a fixed object such as the wall of a pool, a pole or the floor.

Preferably, the device comprises an impact-resistant, water-tight case with a pressure-sensitive area on the surface of the case. The pressure-sensitive area preferably is raised above the surface of the case, and contact between the device and a fixed surface depresses the pressure-sensitive area to effect timing or counting. The case preferably also includes appendages for affixing an adjustable strap to attach the device to the body.

Preferably, timing and counting are effected electronically using a programmed microprocessor, and the results are displayed to the user using light-emitting diodes or a liquid crystal display. The microprocessor can be programmed to operate in various modes to display various information to the participant such as laps or repetitions completed, total distance traveled, time to complete each lap or repetition, average lap or repetition time, average speed, total elapsed time, real time, and best lap or repetition time. Also, the microprocessor preferably is adapted for programming by the participant to input data regarding a proposed activity.

It is not intended that the invention be summarized here in its entirety. Rather, further features, aspects and advantages of the invention will be set forth in, or will be apparent from, the following description and drawings.

DESCRIPTION OF THE PREFERRED EMBODIMENT

Figure 1:
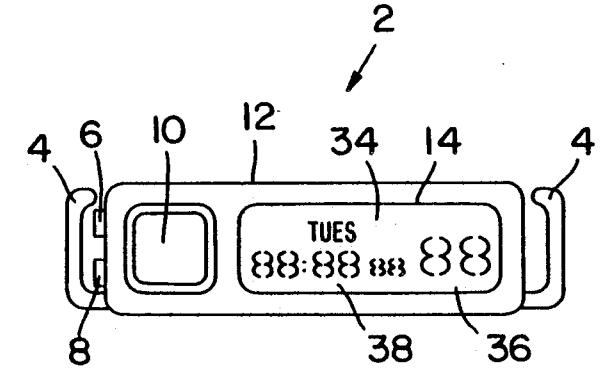
FIG. 1 is a front view of a device for counting and timing laps or repetitions constructed in accordance with the present invention.
Figure 2:
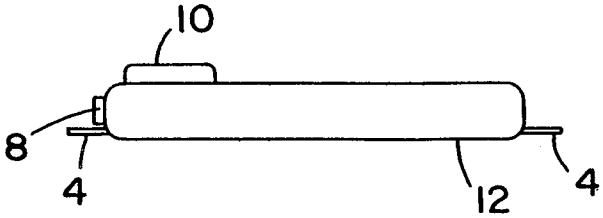
FIG. 2 is a side view of the device shown in FIG. 1

FIGS. 1 and 2 show a front view and side view, respectively, of a portable counting and timing device 2 (hereinafter referred to simply as device 2) constructed in accordance with the present invention.

Device 2 includes a durable, water-tight case 12 which can withstand impact with, e.g., the wall of a pool, a tree or a pole, caused by the user slapping the device with his or her hand or foot against these objects. Case 12 includes at each end appendages 4 over which slip an adjustable strap (not shown) preferably made of an elasticized material to hold device 2 securely and comfortably to the user's body. Case 12 preferably is molded from high quality, durable plastic and has dimensions of approximately 2.2 inches long, 0.7 inches wide and 0.3 inches high to enable it to be worn comfortably and provide little resistance to motion through air or water.

Figure 3:
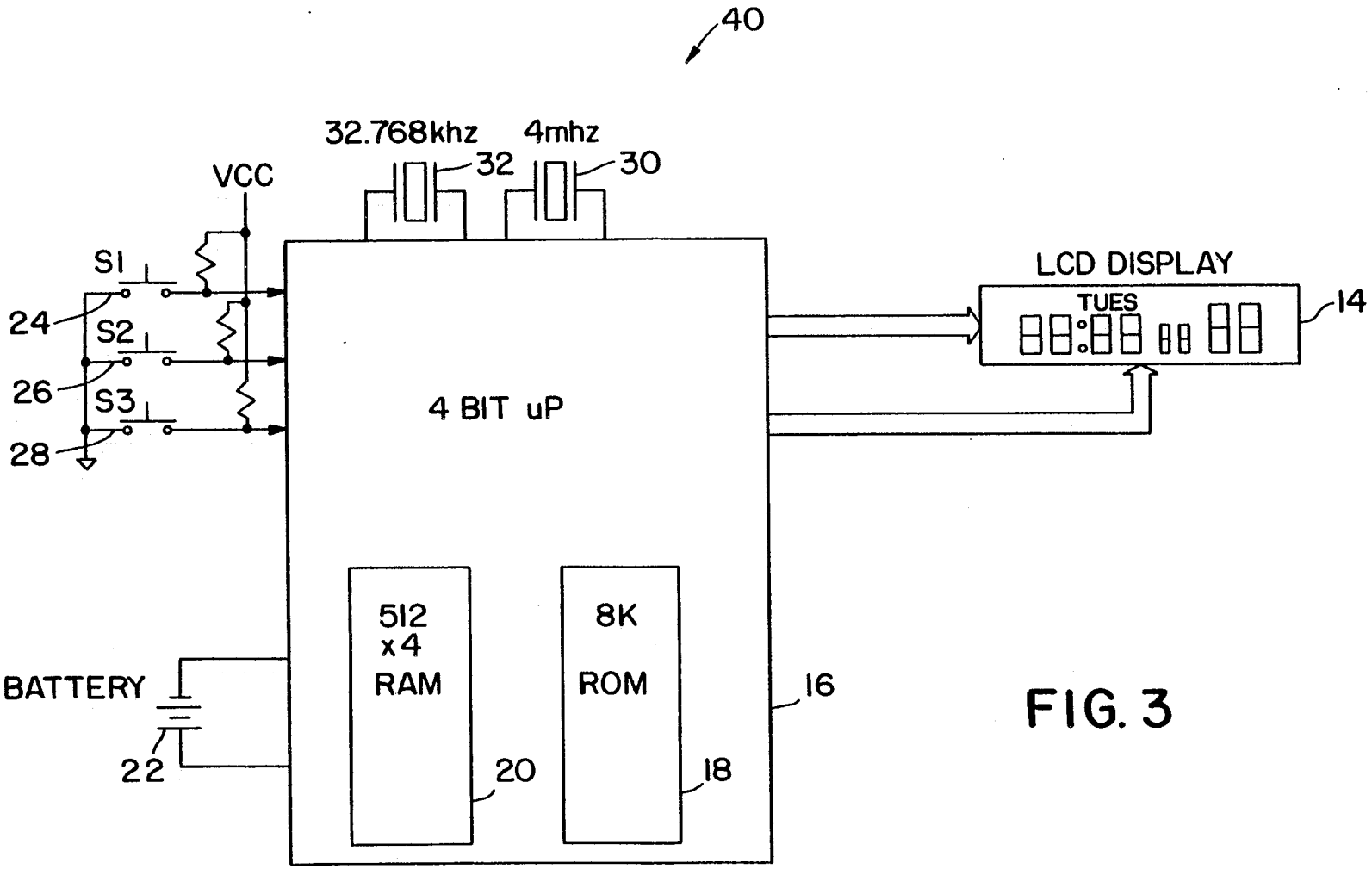
FIG. 3 shows an electronic circuit for the device shown in FIG. 1.

A raised, pressure-sensitive area 10 extends above the front surface of case 12 which absorbs the initial force of contact between the surface of the case and a fixed surface. A force upon pressure-sensitive area 10 causes this area to depress inwardly and activate electronic switch 28 (shown in FIG. 3) to provide a pulse signal to microprocessor 16 (also shown in FIG. 3) enclosed within case 12. The degree of sensitivity to pressure of pressure-sensitive area 10 is such that switch 28 is not activated by the pressure of water to which this area normally is exposed by a swimmer during swimming or diving.

Figure 4:
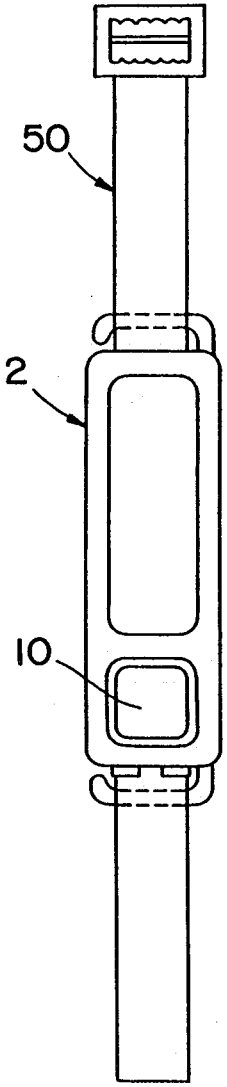
FIG. 4 shows the front view of a device for counting and timing laps or repetitions constructed in accordance with the present invention with fastening means for the wearer.

In FIG. 4, case 12 has been provided with an adjustable strap 50 threaded over the end appendages 4 and under case 12 to be worn in such a manner that the device 2 securely and comfortably attaches to the user's body. Strap 50 may be made of elasticized material and may be used in such a manner as not to slip off the user's body.

Mode selection button 6 and field selection button 8 extend from the side of case 12 and connect to switches 24 and 26 (shown in FIG. 3), respectively. Depressing these buttons activates these switches to provide additional pulse signals to microprocessor 16.

Information is displayed to the user on display 14 which is slightly recessed below the front surface of case 12 for protection. Display 14 is further protected from impacts by the raised pressure-sensitive area 10. Display 14 preferably is constructed from liquid crystals or light-emitting diodes.

A typical informational display is shown on display 14. The day of the week is shown in upper display area 34 of display 14, the lap count is shown in lower right display area 36 (two digits) and the real time is shown in lower left display area 38 (six digits). The right-most two digits of display area 38 display the least significant digits of timing data (seconds or hundredths of a second), and, therefore, their size is smaller than the remaining four digits. The left-most digit of display area 38 displays the most significant digit of timing data which often is 0. When timing is in progress and this digit is 0, a blank is displayed for greater legibility.

Case 12 encloses electronic circuit 40 (shown in FIG. 3) which controls display 14 and the counting, timing and other functions of device 2. Electronic circuit 40 includes a 4 bit microprocessor 16, 8K ROM memory 18 and 4 X 512 RAM memory 20. Three-volt battery 22 provides power to the circuit. Timing signals for circuit 40 are provided by crystal oscillators 30 and 32 which operate at 4 mhz and 32.768 mhz, respectively. Using the pulse signals from switches 24, 26 and 28 and the signals from crystal oscillators 30 and 32, microprocessor 16, ROM memory 18 and RAM memory 20 are programmed to provide an electronic lap counter, lap time timer, elapsed time timer, real time timer and data processor to provide and control the various information depicted in display 14 for the different modes of operation described below. The programming of microprocessor 16, ROM memory 18 and RAM memory 20 to provide these timers and counter and to perform the data processing to provide the information displayed during the modes of operation described below would be known to one skilled in the art, and, therefore, the details of this programming are omitted.

There are nine modes of operation for device 2. Except for the secondary functions of pressure-sensitive area 10 for which depressing the pressure-sensitive area sets the real time timer, selects lap numbers and corresponding lap times from memory, and enters lap length (discussed more fully below under modes 3, 8 and 9), in all modes, depressing pressure-sensitive area 10 increments the lap counter by 1, causes the output of the lap time timer to be stored in memory, resets the lap time timer to 00:00.00, and restarts the lap time timer from that time. Also, except for when pressure-sensitive area 10 is performing these secondary functions, the lap counter counts the depressions of the pressure-sensitive area in all modes consecutively from 00 through 99 and then recycles to 00.

The information displayed in display 14, the effect of depressing mode selection button 6 (switch 24) and field selection button 8 (switch 26), and the secondary functions of depressing pressure-sensitive area 10 for each of the nine modes of operation of device 2 are as follows.

MODE 1: Display area 34 displays LAP, display area 36 displays the output of the lap counter and display area 38 displays the output of the lap time timer. Display area 38 displays, in the three groups of two digits from right to left, hundredths of a second, seconds and minutes, respectively. If the output of the lap time timer exceeds 59:59.99, display area 38 displays, respectively, seconds, minutes and hours for these same groups of two digits, respectively. In this mode, a depression of field selection button 8 has no effect, and a depression of mode selection button 6 advances device 2 to mode 2.

MODE 2: Display area 34 displays ELAP, display area 36 displays the output of the lap counter, and display area 38 displays the output of the elapsed time timer. As in mode 1, the three groups of two digits from right to left of display area 38 display hundredths of a second, seconds and minutes, respectively, up to 59:59.99, after which these same groups of digits display, respectively, seconds, minutes and hours. Depressing mode selection button 6 advances device 2 to mode 3, and depressing field selection button 8 resets the elapsed time timer to 00:00.00.

MODE 3: Display area 34 displays either MON, TUES, WED, THUR, FRI, SAT, or SUN, display area 36 displays the output of the lap counter, and display area 38 displays the output of the real time timer. The three groups of two digits from right to left of display area 38 display the seconds, minutes and hours, respectively, of the real time. Depressing mode selection button 6 advances device 2 to mode 4, and depressing field selection button 8 enables the real time timer to be set as follows.

The first depression of field selection button 8 causes the right two digits of display area 38 to blink. Depressing pressure-sensitive area 10 while these digits are blinking sets these digits to 00. The second depression of field selection button 8 causes the left group of two digits of display area 38 to blink, and each depression of pressure-sensitive area 10 while they are blinking increments their magnitude by 1 up to 12 after which their count recycles to 01. A third depression of field selection button 8 causes the left digit of the middle two digits of display area 38 to blink, and each depression of pressure-sensitive area 10 while this digit is blinking increments its magnitude by 1 up to 5 after which it recycles back to 0. A fourth depression of field selection button 8 causes the right digit of the middle two digits to blink, and each depression of pressure-sensitive area 10 while it is blinking increments its magnitude by 1 up to 9 after which it recycles back to 0. A fifth depression of field selection button 8 causes display area 34 to blink, and each depression of pressure-sensitive area 10 while it is blinking advances by one day the day displayed in this area. A sixth depression of field selection button 8 causes the blinking field to return to the digits representing seconds, and subsequent depressions of this same button causes the blinking field to cycle through display area 38 in the identical manner. Depressing mode selection button 6 cancels the ability of pressure-sensitive area 10 to set the real time timer.

MODE 4: Display area 34 displays BEST, display area 36 displays from memory the output of the lap counter for which the lap time timer recorded the shortest time, and display area 38 displays from memory the output of the lap time timer corresponding to this lap number. If the shortest time is less than one hour, the three groups of two digits from right to left of display area 38 display hundredths of a second, seconds and minutes, respectively. If this time is one hour or greater, these same groups of digits display, respectively, seconds, minutes and hours. A depression of field selection button 8 has no effect, and a depression of mode selection button 6 advances device 2 to mode 5.

MODE 5: Display area 34 displays AVG, display area 36 displays the output of the lap counter, and display area 38 displays the result of the output from memory of the elapsed time timer, at the time of the last incrementation of the lap counter, divided by the output of the lap counter. This time is the average time for completing a lap for the number of laps displayed in display area 36. If the average time is 59:59.00 or less, the three groups of two digits from right to left of display area 38 display, respectively, hundredths of a second, seconds and minutes. If the average time is one minute or greater, these same groups of digits display, respectively, seconds, minutes and hours. The depression of field selection button 8 has no effect, and the depression of mode selection button 6 advances device 2 to mode 6.

MODE 6: Display area 34 displays MILES or KILOS, display area 36 displays the output of the lap counter and display area 38 displays the result of the output of the lap counter multiplied by the length of a lap in miles or kilometers. The length of a lap is entered into memory during mode 9 in the manner described under the description for this mode. The number appearing in display area 38 is the total distance traveled in miles or kilometers, depending on the word appearing in display area 34, for the number of laps appearing in display area 36. If display area 34 displays MILES, the number appearing in display area 38 is the total miles traveled, and if display area 34 displays KILOS, the number appearing in display area 38 is the total kilometers traveled. The decimal point for this number appears between the second and third digits from the left. If display area 34 displays MILES, depressing field selection button 8 changes this display, and the corresponding number appearing in display area 38, to KILOS and vice versa. Subsequent depressions of field selection button 8 toggle the display appearing in display area 34, and the corresponding number in display area 38, between MILES and KILOS. Depressing mode selection button 6 advances device 2 to mode 7.

MODE 7: Display area 34 displays MPH or KPH, and display area 36 displays the output of the lap counter. If display area 34 displays MPH, display area 38 displays $(LC \times LLF)/5280)/(ETT/60)$, where LC is the output of the lap counter, LLF is the lap length in feet and ETT is the output from memory of the elapsed time timer in minutes at the time of the last incrementation of the lap counter. The number in display area 38 is the average speed in miles per hour to travel the number of laps displayed in display area 36. If display area 34 displays KPH, display area 38 displays $(LC \times LLM)/1000)/(ETT/60)$, where LLM is the lap length in meters. This number is the average speed in kilometers per hour to travel the laps displayed in display area 34. The decimal point for the number displayed in display area 38 is between the second and third digit from the left. If MPH appears in display area 34, depressing field selection button 8 changes this display, and the corresponding number in display area 38, to KPH and vice versa. Subsequent depressions of field selection button 8 toggle these displays between MPH and KPH. Depressing mode selection button 6 advances device 2 to mode 8.

MODE 8: Display area 34 displays SPLIT, display area 36 displays the number of a selected completed lap, and display area 38 displays from memory the output of the lap time timer for the lap selected. If this time is less than one hour, the three groups of 2 digits from right to left of display area 38 display, respectively, hundredths of a second, seconds and minutes. If this time is one hour or greater, these same groups of digits display, respectively, seconds, minutes and hours. Depressing field selection button 8 enables each subsequent depression of pressure-sensitive area 10 to advance by 1 the number of the selected completed lap appearing in display area 36, and the time from memory for the selected lap appearing in display area 38 changes accordingly, up to 99 or the output of the lap counter, whichever is smaller, after which a depression of pressure-sensitive area 10 recycles the selected lap number to 01. Depressing mode selection button 6 cancels the ability of pressure-sensitive area 10 to advance the number appearing in display area 36, and a second depression of mode selection button 6 advances device 2 to mode 9.

MODE 9: Display area 34 displays FEET or METER, and display area 36 displays the output of the lap counter. If display area 34 displays FEET, display area 38 displays the length of a lap in feet, and if display area 34 displays METER, display area 38 displays the length of a lap in meters. The decimal point for display area 38 appears between the second and third digits from the right, and the two digits to the right of the decimal point are not displayed. Depressing mode selection button 6 advances device 2 back to mode 1, and depressing field selection button 8 enables the lap length to be set as follows.

The first depression of field selection button 8 causes the left-most digit of display area 38 to blink. Depressing pressure-sensitive area 10 while this digit is blinking increments the magnitude of this digit by 1, up to 9, after which its magnitude recycles to 0. A second depression of field selection button 8 causes the second digit from the left to blink, and each depression of pressure-sensitive area 10 while it is blinking increments its magnitude by 1 in the same manner. The magnitude of the third and fourth digits from the left also are set in this same manner after which depressing field selection button 8 causes the blinking field to move to display area 34. Depressing pressure-sensitive area 10 while display area 34 is blinking toggles the word appearing in this display area between FEET and METERS, and the number displayed in display area 38 also toggles accordingly. Another depression of field selection button 8 returns the blinking field to the left-most digit of display area 38, and subsequent depressions of this button cause the blinking field to cycle through display area 38 in the same manner as described. Depressing mode selection button 6 cancels the ability of pressure-sensitive area 10 to set the lap length, and a second depression of mode selection button 6 advances device 2 back to mode 1.

In all modes, depressing simultaneously both mode selection button 6 and field selection button 8 causes display area 34 to display PAUSE and stops both the lap time timer and elapsed time timer. Depressing pressure-sensitive area 10 while device 2 is in the pause state restarts both timers and returns device 2 to the mode existing prior to its entering this state. The lap counter is not incremented, however, until the next depression of pressure-sensitive area 10. If while in the pause state, both mode selection button 6 and field selection button 8 are depressed simultaneously again, the pause state continues but memory is cleared, both the lap time timer and elapsed time timer are set to 00:00.00 and the lap counter is set to 00.

Generally, prior to use, both mode selection button 6 and field selection button 8 are simultaneously depressed twice to clear the lap time timer, elapsed time timer and lap counter. Mode selection button 6 then is depressed until mode 9 is reached, and the lap length, in feet or meters, is entered into memory as described above. The user then attaches device 2 to an appropriate location on his or her body for which contact can be made between pressure-sensitive area 10 and a solid surface at the conclusion of a lap or repetition without disrupting the natural action of the activity. Generally, this location will be the palm of the user's hand or the ball of his or her foot. When used for swimming, the user's touching of, or kicking off from, the wall of the pool at the conclusion of each lap automatically depresses pressure-sensitive area 10. When used for running, the device preferably is worn in the palm of the user's hand and a solid object along the track, such as a tree or pole, is slapped each time it is passed. Alternatively, a part of the user's body can be slapped, such as the leg, or the user can depress pressure-sensitive area 10 with his or her thumb upon completing each lap. When used for floor exercises such as push-ups, the device can be worn about the chest such that pressure-sensitive area 10 is depressed by contact with the floor during each repetition.

If the user desires to rest during an event but does not want his or her rest time recorded by the lap time timer and elapsed time timer, both mode selection button 6 and field selection button 8 can be depressed simultaneously. When the user desires to resume the activity, pressure-sensitive area 10 is depressed to reactivate these timers.

Generally, during an activity, device 2 is left in either mode 1, to display the number of laps completed and the time to complete each lap in progress, or in mode 2, to display the number of laps completed and the total elapsed time for the activity. When device 2 is worn in the palm of the hand, the user can easily view display 14, even if his or her vision requires corrective lenses, because the user can position the device as close to, or as far from, the eyes as necessary to bring the display into focus. At the conclusion of the activity, the user then can cycle device 2 through its other modes of operation to learn the real time, his or her best lap time, average lap time, total distance traveled, average speed, and the time to complete each lap.

Thus, device 2 provides an inexpensive, portable device for counting and timing laps or repetitions of an athletic activity which the user can wear comfortably, provides little resistance to air or water, and which can be triggered by the user without interrupting his or her natural action in completing the activity. It can be used without interference by others participating in the activity and does not require the involvement of others to set up or maintain. It can be easily read by the user while the activity is in progress and provides the user with substantial information regarding his or her performance in the activity.

I claim:

1. A portable device for counting and measuring the repetitions of an athletic activity, comprising:

(a) a case;

(b) fastening means for attaching said case to a hand or a foot of a participant in the activity;

(c) counting means enclosed within said case for counting the completion of a repetition;

(d) display means for displaying to the participant the status of said counting means;

(e) single area pressure means for activating said counting means disposed upon said case such that pressure is applicable thereto through contact with a solid surface as part of the participant's natural action in completing a repetition; said single area pressure means being the sole raised area at least a predetermined distance from a portion of said case actuatable in a direction toward said case; and (f) measuring means for determining at least one of the duration of plural repetitions of said athletic activity, a distance travelled by said participant in the course of said athletic activity, a speed attained by the participant in the course of said athletic activity and a split time of said athletic activity.

2. A device as in claim 1, wherein said case is impact-resistant and water-resistant and said fastening means is an adjustable strap for fastening the device to a selected one of the palm of the hand and the sole of the foot.

3. A device as in claim 1, wherein said counting means comprises a microprocessor.

4. A device as in claim 1, wherein said display means comprises a liquid crystal display.

5. A device as in claim 1, wherein said single area pressure means comprises a raised area on a surface of said case adjacent said display means and which moves downwardly toward the surface of said case in response to the application of pressure.

6. A device as in claim 1, wherein said display means also displays to the participant the output of said measuring means and said pressure means also activates said measuring means.

7. A device as in claim 1, further comprising real-time means enclosed within said case to determine real time and wherein said display means also displays to the participant the output of said real-time means.

8. A device as in claim 6, wherein said measuring means further comprises best-time means enclosed within said case to determine the shortest time to complete a repetition and wherein said display means also displays to the participant the output of said best-time means.

9. A device as in claim 6, wherein said measuring means further comprises average-time means enclosed within said case to determine the average time to complete a repetition and wherein said display means also displays to the participant the output of said average-time means.

10. A device as in claim 6, wherein said measuring means further comprises distance means enclosed within said case for determining the total distance traveled by the participant for the number of repetitions recorded by the counting means and wherein said display means also displays to the participant the output of said distance means.

11. A device as in claim 10, wherein said measuring means further comprises speed means enclosed within said case for determining the average speed of the participant to travel said total distance and wherein said display means also displays to the participant the output of said speed means.

12. A device as in claim 6, wherein said measuring means further comprises split means enclosed within said case for measuring the time required to complete a repetition, with the status of the counting means for that repetition, and wherein said display means also displays to the participant the output of said split means.

13. A device as in claim 1, wherein said measuring means further comprises length means enclosed within said case to record the distance traveled during each repetition and wherein said display means also displays to the participant the output of said length means.

14. A device as in claim 1, further comprising selecting means disposed upon said case for selecting the information displayed by said display means.

15. A portable device for measuring the repetitions of an athletic activity, comprising:

(a) a case;

(b) fastening means for attaching said case to a hand or a foot of a participant in the activity;

(c) timing means enclosed within said case for determining the time required to complete a repetition; said timing means being further operative for determining at least one of the duration of plural repetitions of said athletic activity, a distance traveled by said participant in the course of said activity, a speed obtained by the participant in the course of said athletic activity and a split time of said athletic activity;

(d) display means for displaying to the participant the output of said timing means; and (e) single area pressure means for activating said timing means disposed upon said case such that pressure is applicable thereto through contact with a solid surface as part of the participant's natural action in completing a repetition; said single area pressure means being the sole raised area at least a predetermined distance from a portion of said case actuatable in a direction toward said case.

16. A device as in claim 15, wherein said case is impact-resistant and water-resistant and said fastening means is an adjustable strap for fastening the device to a selected one of the palm of the hand and the sole of the foot.

17. A device as in claim 15, wherein said timing means comprises a microprocessor.

18. A device as in claim 15, wherein said display means comprises a liquid crystal display.

19. A device as in claim 15, wherein said single area pressure means comprises a raised area on the surface of said case adjacent said display means and which moves downwardly toward the surface of said case in response to the application of pressure.

20. A device as in claim 15, further comprising counting means enclosed within said case for recording the completion of a repetition and wherein said display means also displays to the participant the output of said counting means and said pressure means also activates said counting means.

21. A device as in claim 15, further comprising real-time means enclosed within said case to determine real time and wherein said display means also displays to the participant the output of said real-time means.

22. A device as in claim 15, wherein said timing means further comprises length means enclosed within said case to record the distance traveled during each repetition and wherein said display means also displays to the participant the output of said length means.

23. A device as in claim 15, further comprising selecting means disposed upon said case for selecting the information displayed by said display means.

24. A portable device for measuring the repetitions of an athletic activity, comprising:

(a) a case;

(b) fastening means for attaching said case to a hand or a foot of a participant in the activity;

(c) counting and timing means enclosed within said case for counting the completion of a repetition and determining the time required to complete said repetition; said counting and timing means being further operative for determining at least one of the duration of plural repetitions of said athletic activity, a distance traveled by said participant in the course of said athletic activity, a speed attained by the participant in the course of said activity and a split time of said athletic activity;

(d) display means for displaying to the participant the output of said counting and timing means; and (e) pressure means for activating said counting and timing means comprising a single raised area on the surface of said case such that pressure is applicable thereto through contact with a solid surface as part of the participant's natural action in completing a repetition; said single raised area being the sole raised area at least a predetermined distance from a portion of said case actuatable in a direction toward said case.

25. A device as in claim 24, wherein said case is impact-resistant and water-resistant and said fastening means is an adjustable strap for fastening the device to a selected one of the palm of the hand and the sole of the foot.

26. A device as in claim 24, wherein said counting and timing means comprises a microprocessor.

27. A device as in claim 24, wherein said display means comprises a liquid crystal display.

* * * * *